United States Patent [19]

Crowe

[11] Patent Number: 4,681,193

[45] Date of Patent: Jul. 21, 1987

[54] ROTARY POWER SLIPS

[75] Inventor: William E. Crowe, Round Rock, Tex.

[73] Assignee: Hughes Tool Company, Houston, Tex.

[21] Appl. No.: 830,895

[22] Filed: Feb. 10, 1986

Related U.S. Application Data

[63] Continuation-in-part of Ser. No. 578,907, Feb. 10, 1984, abandoned.

[51] Int. Cl.[4] ..... B65H 59/10

[52] U.S. Cl. ..... 188/67; 81/57.18; 81/57.19; 173/164; 173/167; 277/166; 277/178; 277/189

[58] Field of Search ..... 188/67, 151 R, 265, 188/353; 303/89; 81/57.18, 57.19, 57.21; 70/181; 173/164, 166, 167; 91/420, 531; 403/50, 51, 316, 319; 277/166, 178, 189; 251/61.1; 92/98 R, 98 D; 267/64.27

[56] References Cited

U.S. PATENT DOCUMENTS

| | | | |
|---|---|---|---|
| 3,579,752 | 5/1971 | Brown | 188/67 |
| 3,995,723 | 12/1976 | Holcomb, Jr. | 92/98 D X |
| 3,999,260 | 12/1976 | Stuckey et al. | 188/67 X |
| 4,024,770 | 5/1977 | Liesenborghs | 92/98 D X |
| 4,333,209 | 6/1982 | Herst | 188/67 |
| 4,345,739 | 8/1982 | Wheatley | 277/166 X |

FOREIGN PATENT DOCUMENTS

| | | | |
|---|---|---|---|
| 2126763 | 12/1971 | Fed. Rep. of Germany | 91/420 |

OTHER PUBLICATIONS

*An Introduction to Hydraulics and Pneumatics,* Bulletin 0225B-1, Parker Fluid Power, 1982, p. 8.2.

*Primary Examiner*—Douglas C. Butler
*Attorney, Agent, or Firm*—H. Dennis Kelly

[57] ABSTRACT

Rotary power slips mounted in the rotary table of an earth drilling rig and having slips for gripping and releasing pipe in the rotary table. The air transfer ring has concentric grooves in the upper surface. An annular seal ring is secured to the body of the rotary power slips and has a pair of air passageways. The air passageways lead to secondary fluid conduits in the body, which, in turn, lead to each end of the pneumatic cylinders to raise and lower the slips. Expansive rings are secured to the surface of the air transfer ring by mounting the edges of the rings into the grooves in the air transfer ring. When air pressure is applied through one of the primary fluid conduits, one of the expansive rings expands and cooperates with the lower surface of the seal ring to form an expansive fluid duct. The air pressure flows through a perforation in the expansive ring into the expansive fluid duct, and then through the air passageway and the secondary fluid conduit to the pneumatic cylinders. A pilot operated check valve maintains pressure in one end of the cylinders to keep the slips in the upper, retracted position. The check valve is opened when positive pressure is applied to the other end of the cylinders.

7 Claims, 6 Drawing Figures

ROTARY POWER SLIPS

This application is a continuation-in-part of application Ser. No. 06/578,907, filed Feb. 10, 1984, now abandoned.

BACKGROUND OF THE INVENTION

1. Field of the Invention:

This invention relates in general to earth drilling equipment and in particular to rotary power slips mounted concentrically with the pipe opening in a rotary drilling table.

2. Description of the Prior Art:

U.S. Pat. No. 4,333,209 (Herst), entitled "Rotary Power Slips", issued on June 8, 1982, discloses rotary power slips having a housing mounted in a rotary table of an earth drilling rig. Air, from a stationary fluid source on the drilling rig, is transferred to pneumatic cylinders in the housing to operate the slips. A perforated annular bladder is expanded to form an expansive fluid duct between a stationary seal ring, connected to the stationary fluid source, and an air transfer plate, which rotates with the housing.

After the slips have been raised by the cylinders, the fluid pressure is cut off, releasing fluid pressure to the cylinders from the stationary source and the seal ring disengages. In prior art devices,such as Herst, mechanical means are used to lock the slips in the raised position. Such mechanical means are subject to jolts and vibrations common to drilling floors. An improved apparatus was needed to lock the slips in the raised position.

In addition, improvements were needed in the rotary power slips, so that the power slips will take more abrasion, leak less, and take more pneumatic pressure. Also, it was desired to provide a seal ring which will be simplier and faster to replace under field conditions.

SUMMARY OF THE INVENTION

Rotary power slips have been improved by replacing the annular perforated bladder with a pair of annular expansive rings, having inner and outer edges mounted in grooves on the upper surface of the stationary air transfer ring. The edges of the expansive rings are held in the grooves by retaining rings. The grooves in the air transfer ring are preferably undercut to form counterbores, into which the edges of the expansive rings are mounted. The rotary power slips of the invention can withstand more abrasion than the rotary power slips in the prior art, and the expansive rings of the invention leak less and are able to take more pressure than the prior art designs. Additionally, the expansive rings, held in place by retaining rings, are easier to service and to replace under field conditions.

The improved rotary power slips of the invention have a pilot operated check valve for holding the air pressure in one end of the pneumatic cylinders to lock the slips in the released position. The check valve is piloted off of the fluid conduit to the other end of the cylinders, so that whenever penumatic pressure is applied to the other end of the cylinders, the check valve will open and allow the slips to be lowered to the gripping position. The pilot operated check valve will thus hold the slips in the upper retracted position when pneumatic pressure from the stationary air source is removed. The slips are not allowed to return to the gripping position, until pneumatic pressure is applied to the proper end of the pneumatic cylinders.

The above, as well as additional objects, features, and advantages of the invention, will become apparent in the following detailed description.

DETAILED DESCRIPTION OF THE PREFERRED EMBODIMENT

Figure 1:
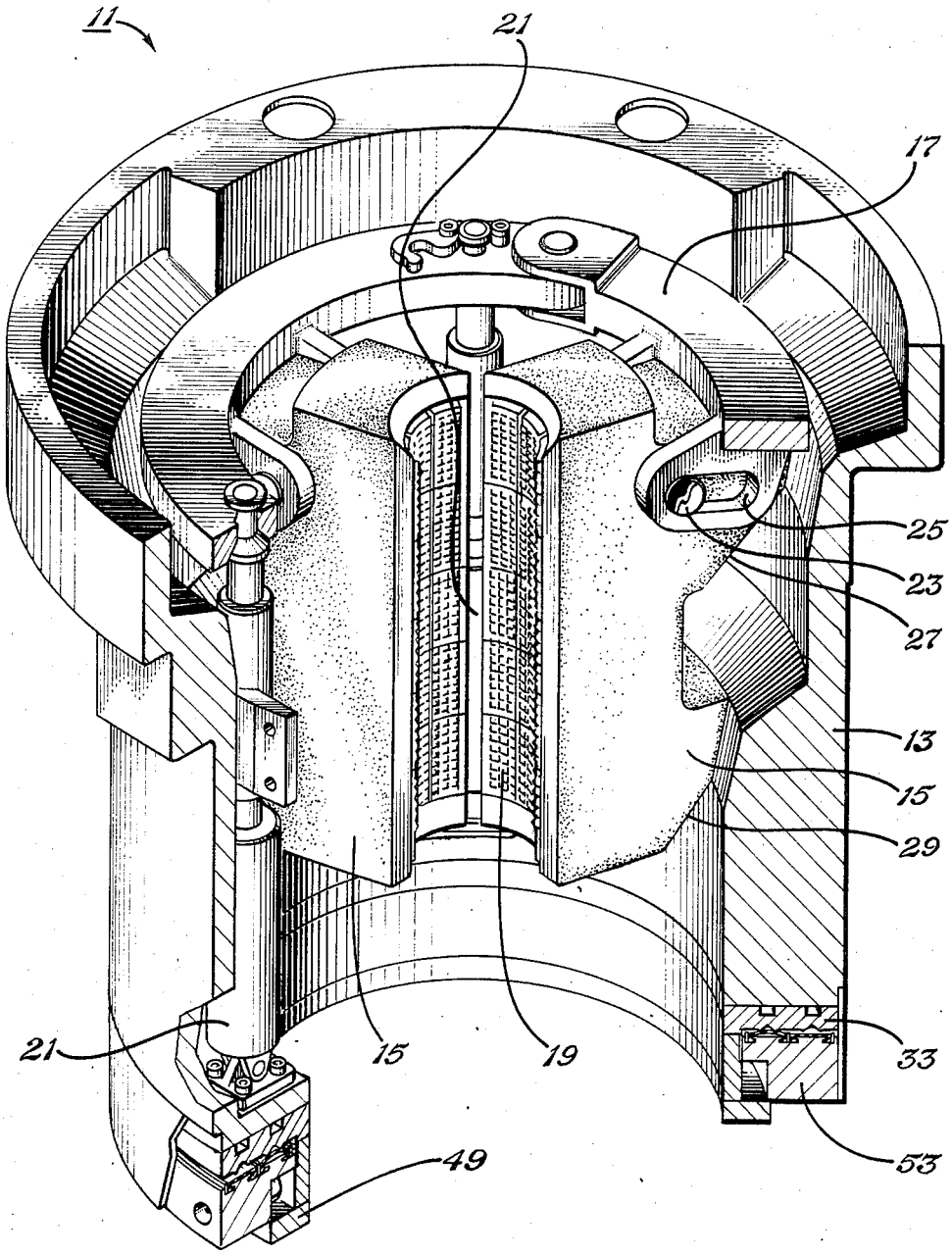
FIG. 1 is a perspective view, partially in section, of the improved rotary power slips of the invention, with the slips in the lower gripping position.
Figure 2:
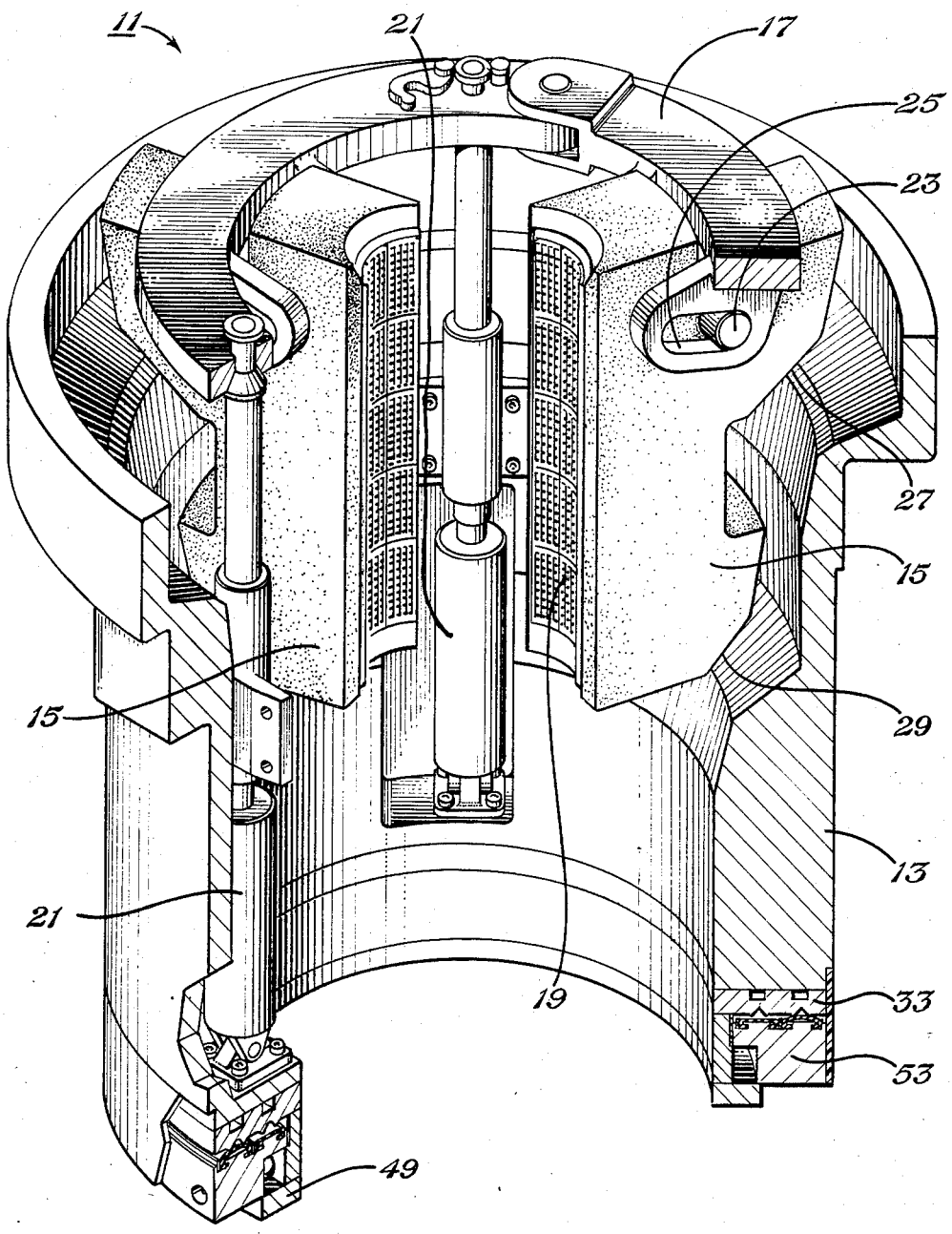
FIG. 2 is a perspective view, partially in section, of the improved rotary power slips of the invention, with the slips in the upper, retracted position.

The improved rotary power slips 11, shown in FIGS. 1 and 2, have a body 13 which is mounted concentrically with the pipe opening in a rotary table of an earth drilling rig. The body 13 is supported by, and rotates with, the rotary table. The body 13 supports three slips 15 which are linked together by a slip ring 17. Each slip 15 has a multitude of replaceable toothed inserts 19, and the slips 16 together form slip means for gripping a pipe within the rotary table when the slips 15 are in their lower, gripping position shown in FIG. 1. When the slips 15 are raised to their upper retracted position, shown in FIG. 2, the slips 15 release the pipe and the pipe may travel freely through the rotary table.

The slips 15 are raised and lowered by means of pneumatic cylinders 21, which are connected to the slip ring 17. The slips 15 are connected to the slip ring 17 by means of rollers 23 which are inserted through elongated slots 25 in the slip ring 17. The rollers 23 move back and forth in the slots 25 as the slips 15 move up and down between the gripping position shown in FIG. 1 and the retracted position shown in FIG. 2. The slips 15 have frusto-conical surfaces 27, 29 which contact the inner surface of the body 13 to move the slips 15 inward and outward between the two slip positions.

Figure 3:
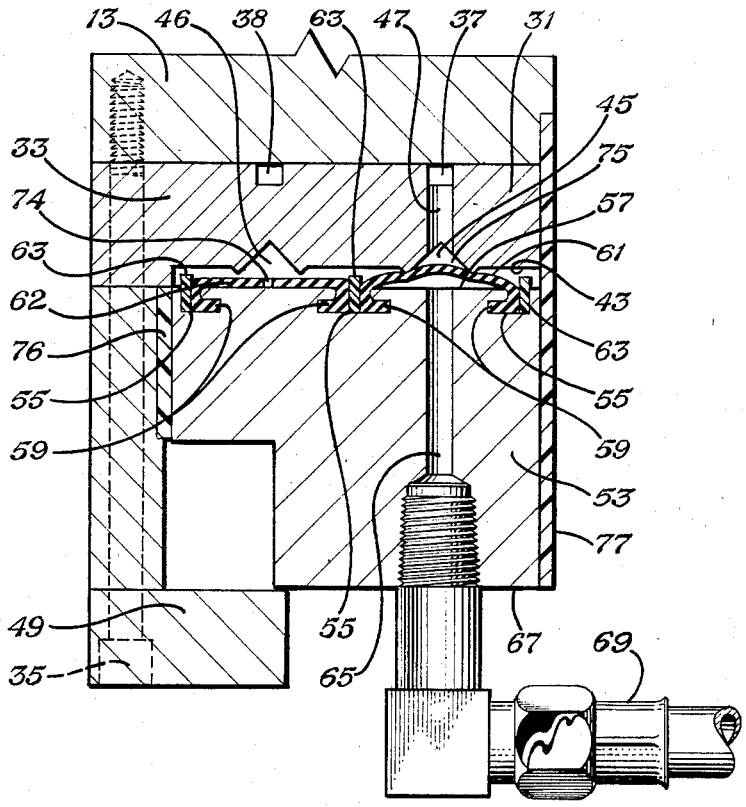
FIG. 3 is a close-up rotational sectional view of the seal ring, the air transfer ring, and the annular expansive rings.
Figure 4:
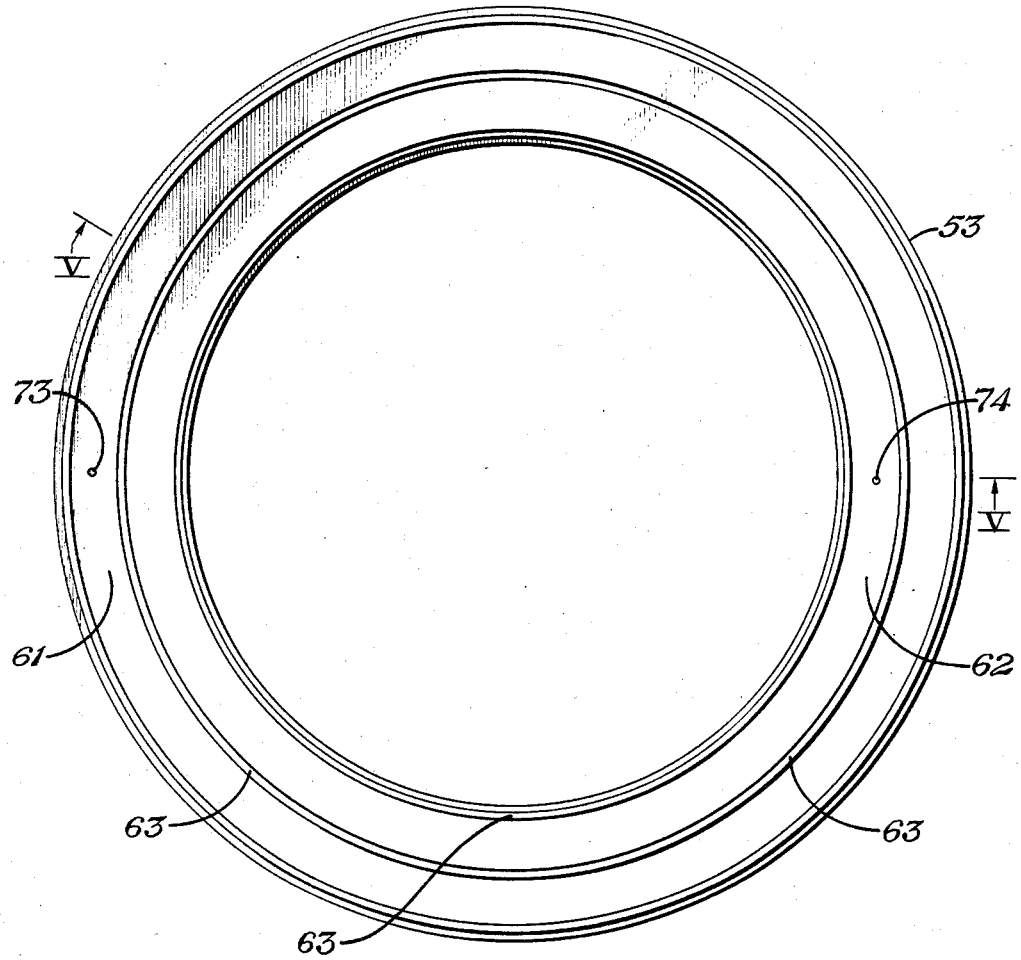
FIG. 4 is a top view of the expansive rings.

The slips 15 and cylinders 21 rotate with the body 13 of the power slips 11. When the body 13 stops rotating, the cylinders 21 may be located in any position around the hole. Air pressure must be delivered to the pneumatic cylinders 21, from a stationary air tank 31 (FIG. 6), regardless of the positions of the cylinders 21 when the rotation of the power slips 11 has ceased. The transfer of air pressure from the stationary components of the power slips 11 to the rotary components is accomplished by means of a seal ring 33, shown in detail in FIG. 3. The seal ring 33 is attached to the bottom of the body 13 by means of bolts 35 and rotates therewith. A pair of annular air passageways 37, 38 are located on the upper side of the seal ring 33. One of these air passageways 37 is in fluid contact with secondary fluid conduts 39 which lead to the upper ends of the pneumatic cylinders 21. The other air passageway 38 is in fluid contact with the secondary fluid conduits 41 which lead to the lower end of the pneumatic cylinders 21. The transverse lower surface 43 of the seal ring 33 also has a pair of annular, triangular grooves 45, 46. The outer air passageway 37 and the outer triangular groove 45 are connected by a single port 47 as shown in FIG. 3. The inner air passageway 38 and the inner groove 46 are likewise connected by a port (not shown) which is located on the opposite side of the seal ring 33.

Figure 6:
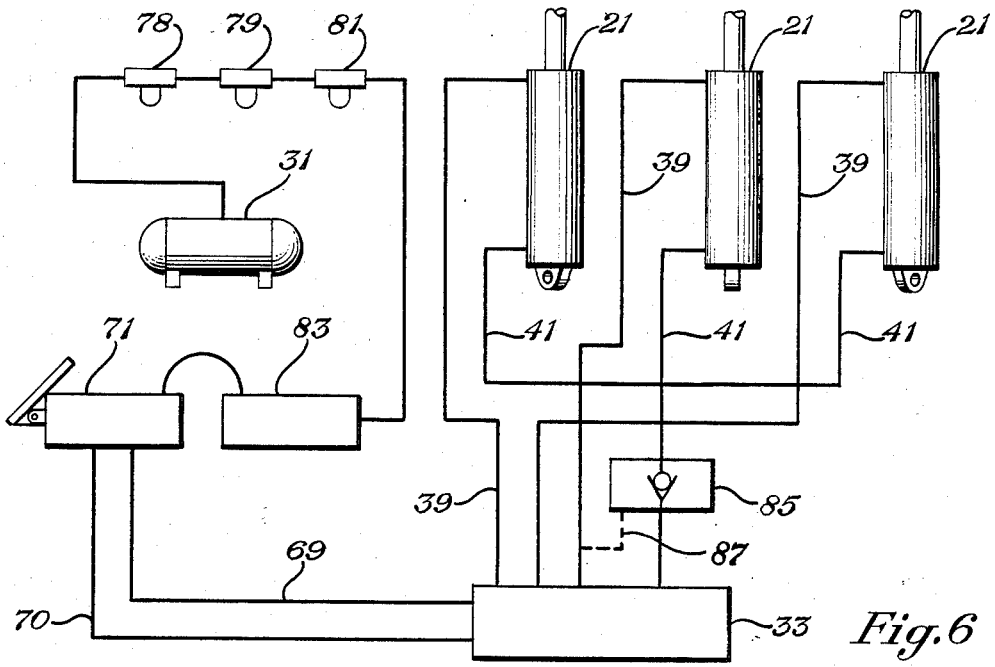
FIG. 6 is a schematic drawing of the pneumatic system for raising and lowering the slips.
Figure 5:
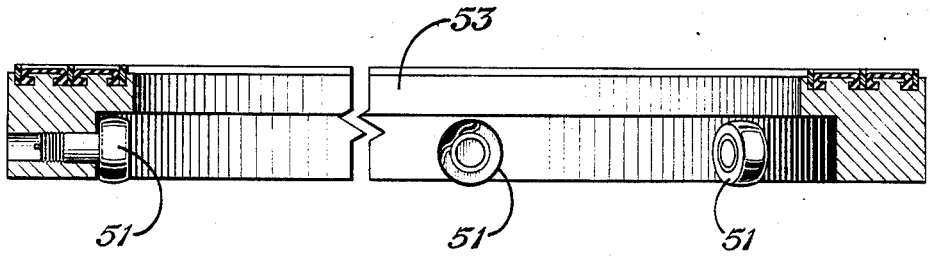
FIG. 5 is a sectional view of the air transfer ring and expansive rings as seen along lines 5—5 in FIG. 4.

An annular bearing support ring 49 is also attached to the body 13 by the bolts 35. The bearing support ring 49 supports six rollers 51, which are attached to an annular air transfer ring 53 as shown in FIG. 5. The air transfer ring remains stationary as the bearing support ring 49 and the body 13 of the rotary power slips 11 rotate. There are three concentric grooves 55 in the transverse upper surface 57 of the air transfer ring 53. These grooves 55 have undercuts to form annular counterbores 59 in the grooves 55. A pair of concentric expansive rings 61, 62 are secured to the upper surface 57 of the air transfer ring 53 by mounting the inner and outer edges of the expansive rings 61, 62 in the counterbores 59 in the grooves 55 on the upper surface 57 of the air transfer ring 53. Retainer rings 63 are placed in the grooves 55, compressed againt the edges of the expansive rings 61, 62 to lock the expansive rings 61, 62 in place. A pair of primary fulid conduits 65 pass through the air transfer ring 53 from the bottom surface 67 to the top surface 57. One of the primary fluid conduits 65 exits beneath the outer expansion ring 61, as shown in FIG. 3. The other primary fluid conduit (not shown) exits the top surface 57 of the air transfer ring 53 beneath the inner expansion ring 62. The primary fluid conduits 65 are in fluid contact with lines 69, 70 which lead to a foot control 71 as shown in FIG. 6. Each expansive ring 61, 62 has a small hole 73, 74 located 180 degrees away from the primary fluid conduit 65 beneath the expansive ring 61, 62. Thus, when air pressure is applied through the primary fluid conduit 65, the expansive ring 61 will be expanded upwards as shown in FIG. 3. The air pressure will then travel around the expansive ring 61 and exit through the hole 73. When the expansive ring 61 is expanded, the expansive ring 61 contacts the lower surface of the seal ring 33 on each side of the groove 45. This forms an annular expansive fluid duct 75. Whenair pressure is applied through the other primary fluid conduit (not shown), the other expansive ring 62 will be expanded. The air pressure then travels around the expansive ring 62 and exits through the hole 74. Expanded ring 62 contacts the seal ring 33 to form an annular expansive fluid duct in the same manner as the outer expansive ring 61. An inner wear strip 76 is located between the air transfer ring 53 and the bearing support ring 49. An outer mud skirt 77 is located on the outer circumference of the air transfer ring 53 to keep drilling mud away from the expansive rings 61, 62.

FIG. 6 illustrates the pneumatic system of the rotary power slips 11. The pneumatic source is an air tank 31 mounted on the drilling rig. Air flow passes from the air tank 31 through a filter 78, a regulator 79, and a lubricator 81 to the safety valve 83. The foot valve 71 then passes the air flow through a selected one of the lines 69, 70 to the seal ring 33. The air flow passes from one of the lines, 69 or 70, to one of the primary fluid conduits 65 thorugh the air transfer ring 53. The air pressure expands one of the expansive rings 61, or 62, until the expansive ring contacts the seal ring 33 to form one of the expansive fluid ducts 75. The air flow passes beneath the expansive ring, 61or 62, to the hole, 73 or 74, and then through the expansive fluid duct 75 to the port 47. The port 47 passes the air flow to the air passageways, 37 or 37, and then on to the secondary fluid conduits, 39 or 41. The secondary fluid conduit 39, or 41, passes the air flow to the top or the bottom of the pneumatic cylinders 21 to raise or lower the slip means 15.

A pilot operated check valve 85 is located in the secondary fluid conduit 41 leading to the bottom of the air cylinders 21. The pilot operated check valve 85 allows free flow from the seal ring 33 to the bottom of the cylinders 21. Flow in the opposite direction, from the bottom of the cylinders 21 to the seal ring 33 is blocked. The check valve 85 is thus a check valve means for holding the pressure in one end of the fluid cylinder 21 to keep the slip means 15 in the raised position. The check valve 85 keeps the slips 15 in the raised position, even if air pressure from the stationary source is cut off.

When it is desired to lower the slips 15, pressure must be applied to the upper end of the cylinders 21 through the secondary fluid conduit 39. Some of this pressure flows through a pilot line 87 to the check valve 85. Pressure in the pilot line 87 causes the check valve 85 to open, allowing pressure to escape from the bottom of the air cylinders 21. As air pressure escapes from the lower end of the cylinders 21, the slips 15 are lowered to their gripping position, as shown in FIG. 1.

In operation, to raise the slips to their retracted position as shown in FIG. 2, air pressure from the air tank 31 is applied through the filter 78, the regulator 79 and the lubricator 81 to the safety valve 83. The foot valve 71 then applies the air pressure through one of the lines 69 to the air transfer ring 53. The air passes through one of the primary fluid conduits 65 to beneath one of the expansive rings 61. The air pressure causes the expansive ring 61 to expand to contact the bottom of the seal ring 33. The expansive ring 61 and the groove 45 in the seal ring 33 create a expansive fluid duct 75. The air beneath the expansive ring 61 passes through the hole 73 into the expansive fluid duct 75. The air then passes through the port 47 to an air passageway 37. The air passageway 37 conducts the air through the check valve 85 to the secondary fluid conduits 41 in the body 13 of the rotary power slip 11. The air in the top of the air clyinders 21 is exhausted through secondary fluid conduits 39, and the secondary fluid conduits 41 conduct the air to the bottom of the air cylinders 21 to raise the slip ring 17 and the slips 15 to the upper retracted position shown in FIG. 2. The check valve 85 prevents the air pressure in the lower half of the air cylinder 21 from escaping and locks the slips 15 in the raised position. The foot valve 71 is then moved to a neutral position, removing fluid pressure from the seal ring 33.

In order to lower the slips 15, air pressure from the air tank 31 is fed by the foot control 71 through the other line 70 to the air transfer ring 53. The line 70 is connected to the other primary fluid conduit (not shown). The primary fluid conduit (not shown) conducts the air to beneath the other expansive ring 62. The expansive ring 62 is expanded to contact the seal ring 33 and to form the expansive fluid duct 75. The air escapes through the hole 74 into the expansive fluid conduit 75. The air travels through the port (not shown) into the air passageway 38 and then into the secondary fluid conduit 39. The secondary fluid conduit 39 carries the air pressure to the upper half of the pneumatic cylinders 21. The check valve 85 is piloted off of one of the secondary fluid conduits 39, to open the check valve 85 when fluid pressure is applied to the secondary fluid conduit 39. This allows air pressure in the bottom half of the air cylinders 21 to escape through the secondary fluid conduits 41 and allows the slips 15 to be lowered to their gripping position.

The rotary power slips 11 of the invention provide several significant advantages over the prior art. The expansive rings 61, 62 are more reliable and can withstand more pressure and more abrasion than the expansive means used in prior devices. The expansive rings 61, 62 are also easier to service and to replace under field conditions.

The pilot operated check valve 85 makes the improved rotary power slips 11 safer and more economical than prior art devices. The check valve 85 holds the slips 15 in the upward, retracted position, even when air pressure from the stationary source 31 is removed.

While the invention has been shown in only one of its forms, it should be apparent to those skilled in the art that it is not so limited, but is susceptible to various changes and modifications without departing from the spirit thereof.

I claim:

1. Rotary power slips, for use in the rotary table of an earth drilling rig, comprising:

a body;

slip means carried on the body for gripping and releasing pipe in a pipe opening in a rotary table;

a stationary air transfer ring supported by the body, and having a primary fluid conduit for connection to a stationary fluid source on the drilling rig, and having a transverse upper surface with at least two concentric grooves;

an annular seal ring secured to the body and having a transverse lower surface and an air passageway;

expansive means including an expansive ring having inner and outer edges mounted in the grooves on the upper surface of the air transfer ring and cooperative with the lower surface of the seal ring for forming an annular expansive fluid duct to conduct fluid between the primary fluid conduit and the air passageway;

a fluid cylinder mounted on the body and fluidly connected to a secondary fluid conduit through the body to the air passageway for raising and lowering the slip means in response to fluid flow through the primary fluid conduit, the air passageway, and the secondary fluid conduit; and a retainer ring in each of the grooves on the upper surface of the air transfer ring, compressed against one of the edges of the expansive ring for locking the expansive ring in place.

2. Rotary power slips, for use in the rotary table of an earth drilling rig, comprising:

a body;

slip means carried on the body for gripping and releasing pipe in a pipe opening in a rotary table;

a stationary air transfer ring supported by the body, and having a primary fluid conduit for connection to a stationary fluid source on the drilling rig, and having a transverse upper surface with at least two concentric grooves;

an annular seal ring secured to the body and having a transverse lower surface and an air passageway;

an annular expansive ring having inner and outer edges mounted in the grooves on the upper surface of the air transfer ring and cooperative with the lower surface of the seal ring for forming an annular expansive fluid duct to conduct fluid between the primary fluid conduit and the air passageway, the expansive ring having a perforation so that fluid may pass through the expansive ring;

a fluid cylinder mounted on the body and fluidly connected to a secondary fluid conduit through the body to the air passageway for raising and lowering the slip means in response to fluid flow through the primary fluid conduit, the air passageway, and the secondary fluid conduit; and a retainer ring in each of the grooves on the upper surface of the air transfer ring, compressed against one of the edges of the expansive ring for locking the expansive ring in place.

3. Rotary power slips, for use in the rotary table of an earth drilling rig, comprising:

a body;

slip means carried on the body for gripping and releasing pipe in a pipe opening in a rotary table;

a stationary air transfer ring supported by the body, and having a primary fluid conduit for connection to a stationary fluid source on the drilling rig, and having a transverse upper surface with at least two to form oppositely disposed annular counterbores;

an annular seal ring secured to the body and having a transverse lower surface and an air passageway;

an annular expansive ring having inner and outer edges mounted in the counterbores in the grooves on the upper surface of the air transfer ring and cooperative with the lower surface of the annular seal ring for forming an annular expansive fluid duct to conduct fluid between the primary fluid conduit and the air passageway, the expansive ring having a perforation so that fluid may pass through the expansive ring;

a fluid cylinder mounted on the body and fluidly connected to a secondary fluid conduit through the body to the air passageway for raising and lowering the slip means in response to fluid flow through the primary fluid conduit, the air passageway, and the secondary fluid conduit; and a retainer ring in each of the grooves on the upper surface of the air transfer ring, compressed against one of the edges of the expansive ring for locking the expansive ring in place.

4. Rotary power slips, for use in the rotary table of an earth drilling rig, comprising:

a body;

slip means carried on the body for gripping and releasing pipe in a pipe opening in a rotary table;

a stationary air transfer ring supported by the body, and having a pair of primary fluid conduits for connection to a stationary fluid source on the drilling rig, and having a transverse upper surface with at least three concentric grooves;

an annular seal ring secured to the body and having a transverse lower surface and a pair of air passageways;

a pair of annular expansive rings having inner and outer edges mounted concentrically in the grooves on the upper surface of the air transfer ring and cooperative with the lower surface of the seal ring for forming a pair of annular expansive fluid ducts to conduct fluid between the primary fluid conduits and the air passageways, the expansive rings having perforations so that fluid may pass through the expansive rings;

a fluid cylinder mounted on the body and fluidly connected at one end to a secondary fluid conduit through the body to one of the air passageways for raising the slip means in response to fluid flow through one of the primary fluid conduits, one of the the air passageways, and the secondary fluid conduit, and fluidly connected at the other end to a second secondary fluid conduit through the body to the other air passageway for lowering the slip means in response to fluid flow through the other primary fluid conduit, the other air passageway, and the second secondary fluid conduit; and a retainer ring in each of the grooves on the upper surface of the air transfer ring, compressed against one of the edges of the expansive rings for locking the expansive rings in place.

5. Rotary power slips, for use in the rotary table of an earth drilling rig, comprising:

a body;

slip means carried on the body for gripping and releasing pipe in a pipe opening in a rotary table;

a stationary air transfer ring supported by the body, and having a pair of primary fluid conduits for connection to a stationary fluid source on the drilling rig, and having a transverse upper surface with at least three concentric grooves, the grooves being undercut to form two pairs of oppositely disposed annular counterbores;

an annular seal ring secured to the body and having a transverse lower surface and a pair of air passageways;

a pair of annular expansive rings having inner and outer edges mounted in the counterbores in the grooves on the upper surface of the air transfer ring and cooperative with the lower surface of the seal ring for forming a pair of annular expansive fluid ducts to conduct fluid between the primary fluid conduits and the air passageways, the expansive rings having perforations so that fluid may pass through the expansive rings;

a fluid cylinder mounted on the body and fluidly connected at one end to a secondary fluid conduit through the body to one of the air passageways for raising the slip means in response to fluid flow through one of the primary fluid conduits, one of the the air passageways, and the secondary fluid conduit, and fluidly connected at the other end to a second secondary fluid conduit through the body to the other air passageway for lowering the slip means in response to fluid flow through the other primary fluid conduit, the other air passageway, and the second secondary fluid conduit; and a retainer ring in each of the grooves on the upper surface of the air transfer ring compressed against one of the edges of the expansive rings for locking the expansive rings in place.

6. Rotary power slips, for use in the rotary table of an earth drilling rig, comprising:

a body;

slip means carried on the body for gripping and releasing pipe in a pipe opening in a rotary table;

a stationary air transfer ring supported by the body, and having a pair of primary fluid conduits for connection to a stationary fluid source on the drilling rig, and having a transverse upper surface with at least three concentric grooves;

an annular seal ring secured to the body and having a transverse lower surface and a pair of air passageways;

a fluid cylinder mounted on the body and fluidly connected at one end to a secondary fluid conduit through the body to one of the air passageways for raising the slip means in response to fluid flow through one of the primary fluid conduits, one of the air passageways, and the secondary fluid conduit, and fluidly connected at the other end to a second secondary fluid conduit through the body to the other air passageway for lowering the slip means in response to fluid flow through the other primary fluid conduit, the other air passageway, and the second secondary fluid conduit;

pilot operated check valve means in one of the secondary fluid conduits for holding the pressure in one end of the fluid cylinder to keep the slip means in the raised position, the check valve means being piloted off of the other secondary fluid conduit; and a retainer ring in each of the grooves on the upper surface of the air transfer ring, compressed against one of the edges of the expansive rings for locking the expansive rings in place.

7. An apparatus for use in the rotary table of an earth drilling rig, comprising:

a body;

a stationary air transfer ring supported by the body, and having a primary fluid conduit for connection to a stationary fluid source on the drilling rig, and having a transverse upper surface with at least two concentric grooves;

an annular seal ring secured to the body and having a transverse lower surface and an air passageway;

expansive means including an expansive ring having inner and outer edges mounted in the grooves on the upper surface of the air transfer ring and cooperative with the lower surface of the seal ring for forming an annular expansive fluid duct to conduct fluid between the primary fluid conduit and the air passageway; and a retainer ring in each of the grooves on the upper surface of the air transfer ring, compressed against one of the edges of the expansive ring for locking the expansive ring in place.

* * * * *